United States Patent [19]

Richards et al.

[11] Patent Number: 5,005,758

[45] Date of Patent: Apr. 9, 1991

[54] ENVELOPE CONSTRUCTED FOR INK JET PRINTING

[75] Inventors: Judith M. Richards; James H. Beckman, both of Dayton, Ohio

[73] Assignee: Eastman Kodak Company, Rochester, N.Y.

[21] Appl. No.: 117,452

[22] Filed: Nov. 3, 1987

Related U.S. Application Data

[63] Continuation-in-part of Ser. No. 890,884, Jul. 28, 1986, abandoned, which is a continuation-in-part of Ser. No. 809,609, Dec. 16, 1985, abandoned.

[51] Int. Cl.[5] ..... B65D 27/00

[52] U.S. Cl. ..... 229/68 R; 206/610; 206/632; 229/80; 462/6

[58] Field of Search ..... 229/68 R, 69, 76, 80, 229/81; 101/53; 400/531; 493/918; 206/610, 612, 632; 282/11.5 A

[56] References Cited

U.S. PATENT DOCUMENTS

| | | | |
|---|---|---|---|
| 544,277 | 8/1895 | Andrew | 229/81 |
| 712,465 | 10/1902 | Stormfels | 229/81 |
| 1,315,070 | 9/1919 | Arnold | 229/68 R |
| 1,692,219 | 11/1926 | Medveczky . | |
| 1,824,862 | 12/1929 | Young . | |
| 2,129,705 | 9/1938 | Reineman | 229/81 |
| 2,159,957 | 5/1939 | Ormond | 229/68 R |
| 2,907,585 | 10/1959 | Sornberger et al. | 282/11.5 A |
| 3,217,868 | 2/1964 | Champlin et al. . | |
| 3,326,369 | 3/1965 | Tolaas et al. . | |
| 3,434,399 | 3/1969 | Palmer | 229/3.5 MF |
| 3,503,629 | 3/1970 | Bash | 282/11.5 A |
| 3,522,907 | 8/1970 | Ulterbach, Jr. | 229/68 R |
| 3,606,138 | 9/1971 | Allison | 206/632 X |
| 3,655,501 | 4/1972 | Tesch . | |
| 4,134,322 | 1/1979 | Lillibridge | 229/80 X |
| 4,141,449 | 2/1979 | Stone . | |
| 4,237,466 | 12/1980 | Scranton . | |
| 4,342,472 | 8/1982 | Helmann et al. . | |
| 4,416,377 | 11/1983 | Swanberg . | |
| 4,511,042 | 4/1985 | Wischusen . | |
| 4,586,651 | 5/1986 | Bradley | 229/68 R |

FOREIGN PATENT DOCUMENTS

| | | | |
|---|---|---|---|
| 1194517 | 9/1981 | Canada . | |
| 0226990 | 12/1986 | European Pat. Off. . | |
| 2546773 | 4/1977 | Fed. Rep. of Germany | 206/610 |

*Primary Examiner*—Bryon P. Gehman
*Attorney, Agent, or Firm*—Dana M. Schmidt

[57] ABSTRACT

There is disclosed an envelope that is constructed to allow it to be printed using a minimum of modifications to a printer. To achieve this, a leader extension is attached to the envelope by a novel perforation that is more readily severed, and features are included to allow flexure of the envelope around the curved surface of a support drum of the printer. One of such features that permits this is slits formed within a portion of the overlapping edges of the side and bottom panels. Another of such features is the scoring of the central and/or bottom panels to cause the pocket formed by these panels to flex towards the axis of curvature of the drum.

4 Claims, 4 Drawing Sheets

FIG. 5
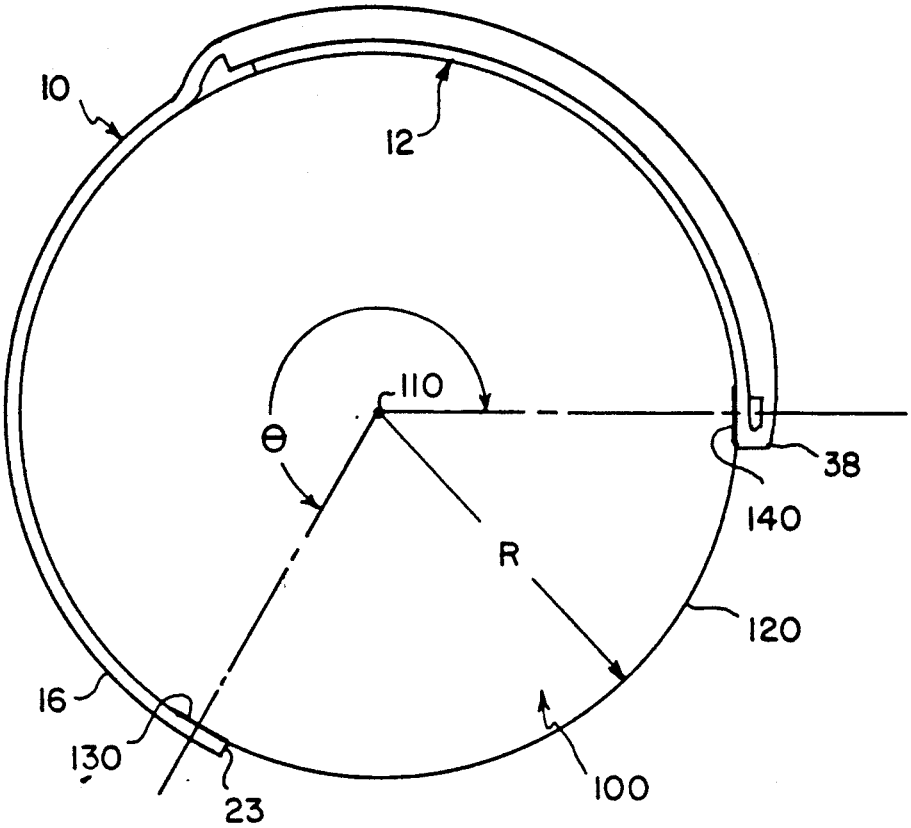
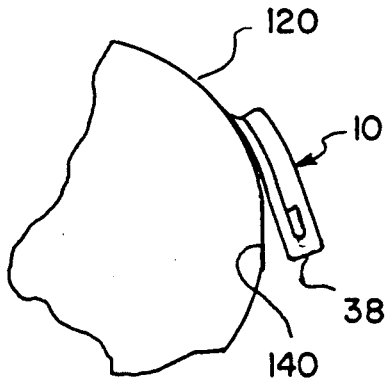
(COMPARATIVE EXAMPLE)
FIG. 6

ENVELOPE CONSTRUCTED FOR INK JET PRINTING

This is a continuation-in-part of application Ser. No. 890,884, filed July 28, 1986, now abandoned, which is a continuation-in-part of application Ser. No. 809,609, filed Dec. 16, 1985, now abandoned.

FIELD OF THE INVENTION

This invention concerns envelopes used in correspondence, and particularly the construction of such envelopes so that they can be printed on ink jet printers.

BACKGROUND OF THE INVENTION

Ink jet printers are quickly becoming a printer of choice for the rapid printing of a variety of documents. Such printers are particularly useful in printing images on a large scale basis. However, one type of document that has not been readily printed in this manner is the envelope. The reason is that a prepared envelope does not behave like a single sheet of paper in the automatic paper handling mechanism of the printer and thus cannot be fed into the printer using the automatic feed, or otherwise handled correctly. The problem is particularly acute in printers that use a rotating drum support and a vacuum holddown, as shown for example in U.S. Pat. No. 4,237,466, issued on Dec. 2, 1980. Because of the folded portions of the envelope forming the pocket, the envelope is too rigid to flex out of its preferred plane to conform to the circumference of the drum, even when using the vacuum hold-down.

The problem then, prior to this invention, was to construct an envelope that could be fed into and handled automatically on ink jet printers, particularly those that used a rotating drum support for the paper being printed. This problem has been aggravated by the necessity to have an envelope that otherwise has the appearance of an ordinary envelope. This appearance requirement occurs because of constraints of acceptable envelope aesthetics demanded by the end-user.

SUMMARY OF THE INVENTION

We have discovered an envelope construction that overcomes the above-noted problems. One aspect of the invention particularly encourages the envelope to conform to the radius of the drum support.

More particularly, in such one aspect of the invention there is provided an envelope comprising a central panel, two side panels, a bottom panel, and a sealing flap, the side panels, bottom panel and sealing flap being foldably connected to the central panel with the side and bottom panels being joined together along overlapping respective edges by joining means to form, with the central panel, the pocket of the envelope, one of the side and bottom panels being on top of the other. The envelope is improved in that at least a portion of the joined edges of the side panels or the bottom panel that are underneath the respective overlapping edge of the other of the joined panels, includes slits of a shape and spacing effective to allow the joined respective edges to stretch while still joined, when the envelope is wrapped around a drum, whereby the envelope can be printed on a printer using a support drum during printing.

In accord with another aspect of the invention, the envelope noted in the first sentence of the preceding paragraph is improved in that at least one of the bottom panel and the central panel is scored along a line extending at least the majority of the width of the envelope, the scoring being done from a side of the paper comprising the envelope that encourages the envelope to flex in one direction only, to approximate a curve with the pocket on the inside of the curve, whereby the envelope can be printed on a printer using a support drum during printing.

In accord with yet another aspect of the invention, there is provided an envelope including a sealing flap, a pocket, and a throw-away portion constructed to be removed prior to sealing the flap to said pocket, the throw-away portion being removably connected to the envelope along a perforated line. This envelope is improved in that a portion of the perforated line is a break-away perforation, the remainder of the line being a tear perforation extending from the break-away perforation.

Thus, it is an advantageous feature of the invention that envelopes constructed in accordance with the invention will readily flex out of their preferred plane, and particularly will take on the radius of the support drum in a printer.

It is a related advantageous feature of the invention that such an envelope is constructed so that the features encouraging such flexing are not readily discernable in the finished envelope.

Yet another advantageous feature of the invention is the provision of an improved perforation for more readily removing for discard, a leader extension used for feeding the envelope to a printer.

Other advantageous features will become readily apparent upon reference to the following Detailed Description of the Preferred Embodiments, when read in light of the attached drawings.

BRIEF DESCRIPTION OF THE DRAWINGS

FIG. 5 is a side elevational view of a support drum in an ink jet printer, with the envelope of the invention mounted thereon having an exaggerated thickness for clarity;

FIG. 6 is a fragmentary side view similar to FIG. 5, but of a comparative example.

DESCRIPTION OF THE PREFERRED EMBODIMENTS

This invention is described hereinafter primarily in connection with the preferred embodiments particularly useful in ink jet printers. That is, the envelope preferably includes slits along one of the overlapping, joined edges of the bottom and side panels, as well as the scoring lines adjacent the bottom edge of the pocket, described hereinafter. In addition, the invention includes envelopes constructed with each of such features separately, and regardless of the printing technology used.

Figure 1:
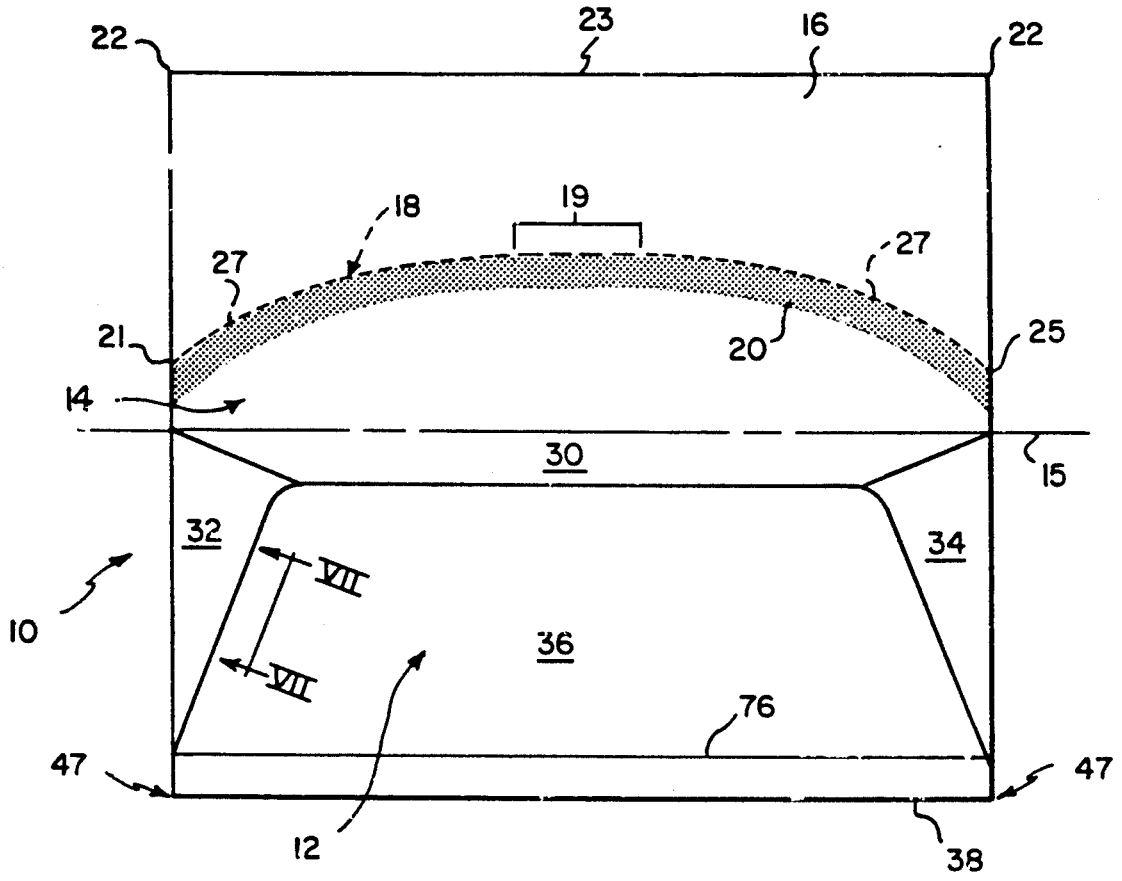
FIG. 1 is a plan view of the back side of an envelope constructed in accordance with the invention.

An envelope 10 prepared in accordance with the invention comprises, FIG. 1, a pocket portion 12 into which the contents (not shown) are placed, and a sealing flap 14 connected to pocket portion 12 along fold line 15. To ensure that the envelope will feed into an ink jet printer properly, a leader extension 16 is provided on flap 14. The leader extension is readily removed after printing by tearing along perforated line 18. Adhesive is applied at portion 20 adjacent to line 18, as is conventional. Preferably, for best feeding results, corners 22 on leading edge 23 of leader extension 16 are relatively sharp corners.

In accordance with one aspect of the invention, perforated line 18 is constructed so as to have break-away perforations in a portion 19 that is approximately midway between ends 21 and 25 of the perforation line. (The lengths of the cuts in portion 19 are exaggerated for clarity.) The remainder portions 27 of the line are tear perforations. As used herein, "break-away" perforations mean those that will sever at the ties merely by pushing an object through portion 19. It has been found that a useful example of a break-away perforation, in contrast to a tear perforation, is one in which the length of the cut is at least 1.5 mm and the length of the tie is 0.2 mm.

The use of the break-away perforation allows the user to more readily initiate the tearing off of the leader extension 16 prior to sealing flap 14 to the pocket portion.

Most preferably, both of the tear perforations 27, FIG. 1, are constructed to provide a so-called "clean edge" after extension 16 is torn away from flap 14. For this purpose, the tear perforation 27 comprises 15–18 ties per cm, with each tie having a length of about 0.025 cm (0.01 inch), and the cuts a correspondingly greater length. An additional useful tear perforation 27 is one which comprises from 18–25 ties per centimeter, the length of each tie and of the cuts being as noted in the previous sentence. A useful method of producing such a tear perforation is described in Canadian Patent No. 1,194,517.

As is conventional, pocket portion 12 comprises a central panel 30, two side panels 32 and 34 hingedly connected thereto, and a bottom panel 36 also hingedly connected to panel 30 along a fold line 38. Panels 32, 34 and panel 36 overlap along their respective edges 42, 44 and 46, respectively, FIG. 2. Panels 32 and 34 do not extend down to fold line 38, so that corners 47 adjacent line 38 are double ply only, for easier handling on the printer.

Figure 2:
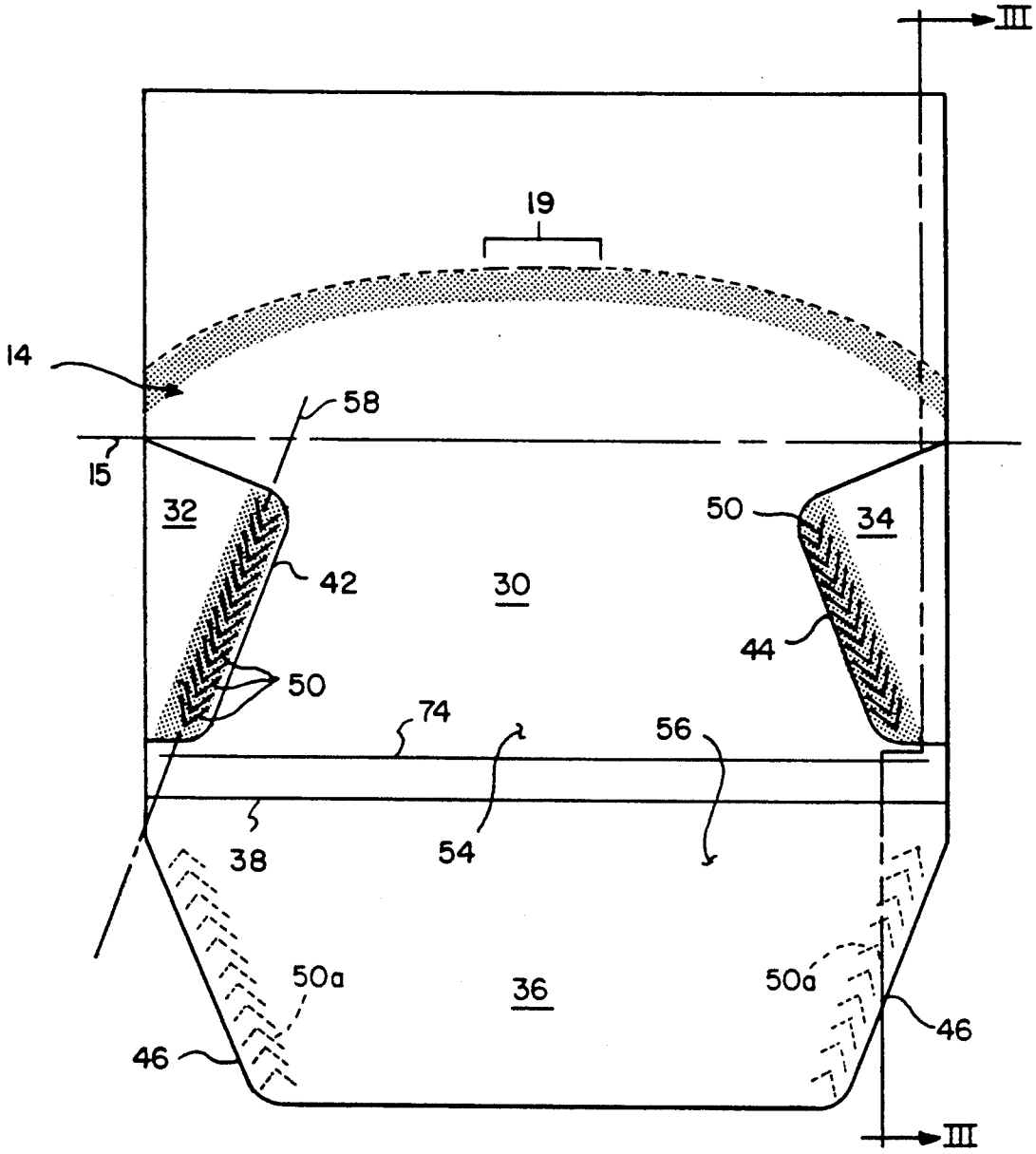
FIG. 2 is a plan view similar to that of FIG. 1, but illustrating the envelope's configuration before the bottom and side flaps are joined together along their overlapping edges.

In accordance with another aspect of the invention, of the panels 32, 34 and 36 that are underneath when assembled (in this embodiment, panels 32 and 34), at least a portion of the panels' overlapping area, shown stipled, FIG. 2, is slit to provide tooth portions 50 extending along most of the overlapping edge. Tooth portions 50 allow panels 32 and 34 to slip, relative to panel 36, and thus the joined edges to stretch, when the envelope is forced out of the plane of the drawing, FIGS. 1 and 2. The slits and therefore the teeth can have a variety of shapes, such as half-moons, and the number, spacing and size of the slits are not believed to be critical. However, each tooth must be complete; that is, the two sides of the "V" must join at the point. Furthermore, it is preferred that each tooth extend into the next tooth to provide a nesting of the teeth, in case the adhesive discussed below spreads out beyond its desired location. Also, the tooth portions 50 can be arranged to point in the opposite direction as well. By way of example, each edge 42 and 44 has adjacent thereto about 14 teeth formed by V slits that are about 7 mm long on each side of the "V", spaced apart about 3 mm.

Adhesive of conventional composition is applied along edges 42, 44 to join them to the overlapped edge 46. Preferably the adhesive is applied at the tips only of each tooth. Most preferably, tooth portions 50 form an alignment 58 that extends diagonally to fold line 15, that is, along a line which, when extended, intersects line 15 at non-orthogonal angles.

Alternatively, the slits can be formed as slits **50*a* in bottom panel 36, FIG. 2, if panel 36 is the innermost panel. In such a case, adhesive is applied as in the case of slits 50, along edges 46 and at the site of slits 50*a*, but on the surface of panel 36 hidden from view in FIG. 2**.

Figure 7:
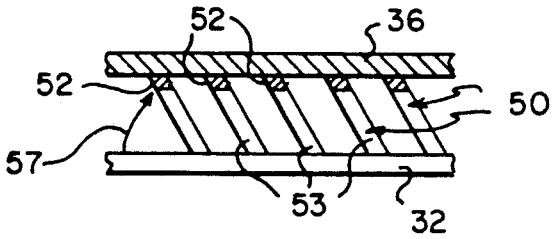
FIG. 7 is a sectional view taken generally along the line VII—VII of FIG. 1.

The effect of this arrangement is to provide a plurality of strips each with the shape $<<$, the point 52, FIG. 7, in each strip being secured by adhesive to panel 36. The ends 53 of each strip are still attached to panel 32 or 34 out of which they are severed. As a result, the strips can hinge up, arrow 57 out of the plane of panel 32 or 34, allowing the panel 36 attached to the tip of each tooth to slip, FIGS. 1 and 2, with respect to panels 32 or 34. It is this relative sliding motion that aids in wrapping the envelope, and specifically pocket 12, about the drum support of a printer.

When bottom panel 36 is folded over to seal against panels 32 and 34, tooth portions 50 are covered, and the envelope appears to be conventional.

Alternatively, panel 36 can be the one that is folded under, so that panels 32 and 34 are on top of it (not shown). In that case, tooth portions 50 are formed in the overlapped portions of panel 36 adjacent to edges 46.

Figure 3:
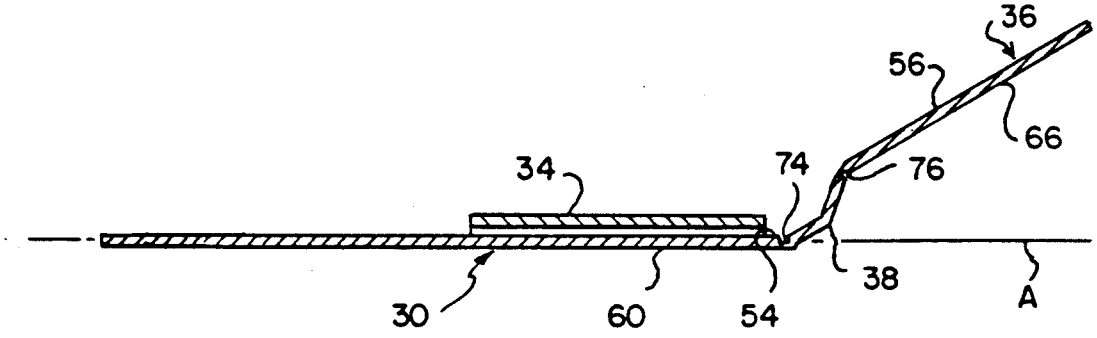
FIG. 3 is a section view taken generally along the line III—III of FIG. 2.
Figure 4:
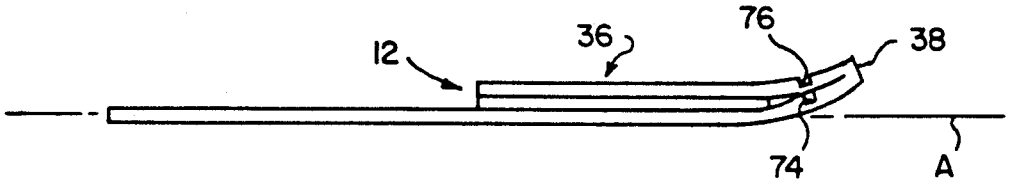
FIG. 4 is a side elevational view of the envelope of FIG. 3, after it has been completely formed prior to printing.

In accord with another aspect of the invention, pocket 12 is preferably formed so as to be predisposed to flex fold line 38 up away from plane A, FIGS. 3 and 4, which is otherwise the preferred plane of the envelope. The reason is that many print heads on ink jet printers have a very close spacing away from the rotating support drum. If the object on the drum protrudes much from the surface, e.g., as much as 0.8 mm, there is in many ink jet printers a high probability that the print head will physically strike the object, instead of just the jet of ink striking it. Such striking will cause a smearing of ink as well as potential harm to the print head.

It will be readily appreciated that a relatively stiff object, such as paper with several folds, as in an envelope, will tend to have its extreme edges project off the drum when held by a vacuum on the drum. Thus, it is preferred that the envelope be constructed so that edge 38 is biased to curve into the drum, particularly for printers having a close print head spacing. This is preferably accomplished as follows: Panels 30 and 36 have inner surfaces 54 and 56, respectively, and outer surfaces 60 and 66, respectively, FIG. 3. To cause such bias to edge 38, inner surface 54 of panel 30 and outer surface 66 of panel 36 are scored along at least the majority of the width of each panel, forming score lines 74 and 76, respectively. Most preferably, score lines 74 and 76 extend the full width of the panel, as shown. Less than full width, or even discontinuous scoring, is useful for print heads having a greater spacing, and in some cases, the score lines can be omitted entirely. Alternatively (not shown), only one of the two panels can be scored if less bias of edge 38 out of plane A is needed. As is well known, the surface of a sheet that is scored tends to form a concave surface, and if the score is linear, the curve of the concave surface will be cylindrical about an axis parallel to such linear score. Because panel 36 is bent back over panel 30, the scoring is done on opposite surfaces 54 and 66, so that the flexing after assembly by folding, FIG. 4, is in the same direction for both panels, e.g., about an axis of curvature above the plane A as shown in FIG. 4.

Most preferably, score lines 74 and 76 are located relative to fold line 38 so that the two lines are superimposed when pocket 12 is fully formed. A useful, but not limitive, example is one in which the score lines are 1 cm from edge 38.

It will be readily appreciated that score line 76 is not readily discernable by the ultimate user of the envelope, and further, that tooth portions 50 that allow relative slippage between panels 32 and 34, and panel 36, are also relatively non-discernable while covered and sealed by the outer panel 36.

With the above features, the envelope will readily accommodate itself to the support drum of an ink jet printer. That is, FIG. 5, such a drum 100 has a radius of curvature R centered on an axis of curvature 110, and a support surface 120. As an example, R can be about 5 cm. Envelope 10 is placed onto the drum with flap extension 16 leading and the pocketside (12) down, or in other words, flipped over from the position shown in FIG. 4. It is held this way by vacuum, most preferably, for the actual printing. The vacuum is applied at least at flat portions 130 and 140, which line up with the leading and trailing edges 23 and 38 of the envelope. A preferred construction is one in which angle $\theta$ is about 245°. It will be readily apparent that the predisposed flexure of pocket 12 in one direction only, out of plane A, FIG. 4, causes it to curve about an axis of rotation that favors the wrapping of the envelope about surface 120.

Failure to provide score lines 74 and/or 76 tends to cause envelope 10 to mount as shown in FIG. 6, with edge 38 protruding too far from surface 120.

The invention has been described in detail with particular reference to preferred embodiments thereof, but it will be understood that variations and modifications can be effected within the spirit and scope of the invention.

What is claimed is:

1. In an envelope comprising a central panel, two side panels and a bottom panel foldably connected to said central panel so that the side panels and bottom panel are joined to each other along respective overlapping edges to form, with said central panel, the pocket of the envelope, joining means applied to said overlapping edges, and a sealing flap, foldably connected to said central panel, the improvement wherein said side, central and bottom panels are constructed to permit flexure of the envelope out of a single plane, said constructed panels including, (a) in at least a portion of said joined edges of the innermost one of said side panels or said bottom panel that are underneath the respective overlapping edges of the other of said joined panels, means defining slits of a shape and spacing effective to allow said joined respective edges to stretch while still joined, when wrapped around an axis extending parallel to said plane, said slits being located at the site of said joining means, and scoring in said bottom panel and said central panel, said lines (a) extending at least the majority of the width of said envelope and parallel to said axis, and (b) being positioned and formed in one side only of said envelope so as to flex said panels in one direction only to approximate a curve favoring wrapping of the envelope around said axis, whereby said envelope can be printed on a printer using a drum support during printing.

2. An envelope as defined in claim 1, wherein said central and said bottom panels each have an inner surface and an outer surface, the inner surfaces being faced together to form said pocket, said score lines being formed in the inner surface of said central panel and the outer surface of said bottom panel.

3. An envelope as defined in claim 1, wherein said bottom panel is folded relative to said central panel so as to cause said score lines to be superimposed one above the other in the finished pocket.

4. An envelope as defined in claim 1, wherein said slits form teeth on a line that extends non-orthogonally to the line of foldable connection of said sealing flap to said central panel.

* * * * *